US010815558B2

(12) United States Patent
Voloshin et al.

(10) Patent No.: US 10,815,558 B2
(45) Date of Patent: Oct. 27, 2020

(54) METHOD FOR PREPARING RODS FROM TITANIUM-BASED ALLOYS

(71) Applicants: STOCK COMPANY "CHEPETSKY MECHANICAL PLANT" (SC CMP), Udmurtskaya Respublika (RU); JOINT STOCK COMPANY "SCIENCE AND INNOVATIONS", Moscow (RU)

(72) Inventors: Andrej Vladimirovich Voloshin, Udmurt Republic (RU); Aleksandr Yevgenyevich Moskalev, Udmurt Republic (RU); Dmitrij Alekseevich Negodin, Udmurt Republic (RU); Dmitrij Valerievich Nikulin, Udmurt Republic (RU); Iurij Panteleevich Samoilov, Udmurt Republic (RU)

(73) Assignee: Stock Company "Chepetsky Mechanical Plant" (SC CMP), Udmurtskaya Respublika (RU)

( * ) Notice: Subject to any disclaimer, the term of this patent is extended or adjusted under 35 U.S.C. 154(b) by 21 days.

(21) Appl. No.: 16/065,401

(22) PCT Filed: Dec. 22, 2015

(86) PCT No.: PCT/RU2015/000912

§ 371 (c)(1),
(2) Date: Jun. 22, 2018

(87) PCT Pub. No.: WO2017/111643

PCT Pub. Date: Jun. 29, 2017

(65) Prior Publication Data

US 2019/0017159 A1 Jan. 17, 2019

(51) Int. Cl.

| | |
|---|---|
| ***C22F 1/18*** | (2006.01) |
| ***B21J 5/00*** | (2006.01) |
| ***B21C 37/04*** | (2006.01) |
| ***B21B 3/00*** | (2006.01) |

(52) U.S. Cl.

CPC ..... *C22F 1/183* (2013.01); *B21B 3/00* (2013.01); *B21C 37/04* (2013.01); *B21C 37/045* (2013.01); *B21J 5/00* (2013.01)

(58) Field of Classification Search

CPC .. C22F 1/183; B21J 5/00; B21C 37/04; B21C 37/045; B21B 3/00

See application file for complete search history.

(56) References Cited

FOREIGN PATENT DOCUMENTS

| | | |
|---|---|---|
| RU | 2175994 | 11/2001 |
| RU | 2312722 | 12/2007 |

*Primary Examiner* — Jessee R Roe

(74) *Attorney, Agent, or Firm* — Brandon V. Zuniga; James R. Gourley; Carstens & Cahoon, LLP

(57) ABSTRACT

The invention relates to the pressure processing of metals, and specifically to methods for preparing rods and workpieces from titanium alloys, with applications as a structural material in nuclear reactor cores, in the chemical and petrochemical industries, and in medicine. The invention solves the problem of producing rods from high-quality titanium alloys while simultaneously ensuring the high efficiency of the process. A method for preparing rods or workpieces from titanium alloys includes the hot forging of an initial workpiece and subsequent hot deformation, the hot forging of an ingot is carried out following heating, with shear deformations primarily in the longitudinal direction and a reduction ratio of k=(1.2–2.5), and then performing hot rolling forging, without cooling, changing the direction of shear deformations to being primarily transverse and with a reduction ratio of up to 7.0, and conducting subsequent hot deformation by heating deformed workpieces.

3 Claims, No Drawings

METHOD FOR PREPARING RODS FROM TITANIUM-BASED ALLOYS

CROSS-REFERENCE TO RELATED APPLICATIONS

This application is a US 371 Application from PCT/RU2015/000912 filed Dec. 22, 2015, the technical disclosures of which are hereby incorporated herein by reference.

FIELD OF THE INVENTION

The invention relates to metal forming, in particular to methods of rods manufacturing from titanium alloys, which are used as a structural material for nuclear reactor cores, as well as in the chemical, oil and gas industry, and medicine.

BACKGROUND OF THE INVENTION

It is known a method of manufacturing the high-quality rods of wide diameters range from two-phase titanium alloys intended for the production of aerospace parts (RU 2178014, publ. Jan. 10, 2002). The method comprises heating a workpiece to a temperature above the polymorphic transformation (pt) temperature in the β region, rolling at this temperature, cooling to ambient temperature, heating the semi-finished rolled product to a temperature of 20-50° C. below the polymorphic transformation temperature and the final rolling at this temperature. Heating and deformation in the β region is performed in two stages: in the first stage, the workpiece is heated to a temperature of 40-150° C. above the polymorphic transformation temperature, deformed to a deformation degree of 97-97.6% and cooled in the air; in the second stage, the semi-finished rolled product is heated to a temperature by 20° C. above the polymorphic transformation temperature and deformed to a deformation degree of 37-38%; the final rolling in the alpha+beta-region is performed with a deformation degree of 54-55%.

The known method allows obtaining the rods with specified macro- and microstructure providing a stable level of mechanical properties across the rod section. However, the method has low efficiency and long production cycle due to the need for intermediate heating at the stage of hot rolling and machining the rod surface. As a result, the quality of rolled rods is decreased, the level of defective rods is increased, the yield ratio is decreased which ultimately leads to an increase in the cost of rods manufacturing.

It is known a method for manufacturing the intermediate workpieces from titanium alloys by hot deformation (RU 2217260, publ. 27 Nov. 2003). The ingot is forged into a rod in several transitions at the temperature of the β region and intermediate forging for several transitions at the temperature of the β and (α+β) region. Intermediate forging at the temperature of the (α+β) region is performed with a forging reduction of 1.25-1.75. On the final transitions, the mentioned intermediate forging is performed with a forging reduction of 1.25-1.35 into the rod. Then the mechanical processing of the rod, its cutting into the workpieces and the formation of the ends are performed, after which the final deformation is carried out at the temperature of (α+β) region.

The known method has a long production cycle, includes a forming operation which requires pre-machining. The intermediate pre-machining when manufacturing the workpieces for the forming leads to additional losses of metal.

The closest to the claimed method is the method of manufacturing the intermediate workpiece from titanium alloys (patent RU 2409445, publ. Jan. 20, 2011); this method includes hot forging on the forging press in a four-die forging device at a temperature range between 120° C. below the temperature of polymorphic transformation and 100° C. above the temperature of polymorphic transformation, with a total degree of deformation of at least 35%, cooling and subsequent forging at a temperature below the temperature of polymorphic transformation with a total degree of deformation of not less than 25%.

In the known method, the multiple operations of heating for hot forging and air cooling adversely affect the quality of the rod surface. In addition, the method requires an expensive operation of abrasive treatment to remove forging defects and surface substandard layer. As a result, the number of defective products is increased, the yield rate is decreased which ultimately leads to an increase in the cost of rods manufacturing.

SUMMARY

The invention solves the problem of rods production from high-quality titanium alloys while simultaneously ensuring high efficiency of the process.

The technical result is achieved by the fact that, in the method of producing the rods from titanium alloys that includes hot forging of the workpiece and the subsequent hot deformation, hot forging of the ingot is performed after heating to a temperature in the range of (Tpt+20)+(Tpt+150)° C. with shear deformations mainly in the longitudinal direction and a reduction ratio of 1.2-2.5, after which, without cooling, hot rolling of the forged piece is performed in the temperature range of (Tpt+20)+(Tpt+150)° C. with shear deformations in the predominantly transverse direction and a reduction ratio of up to 7.0; the subsequent hot deformation is carried out by heating the deformed workpieces in the temperature range from (Tpt−70) to (Tpt−20)° C.

In a particular case, for example, for a long forging process, before hot rolling, the semi-finished forgings are heated to a temperature in the range from (Tpt+20) to (Tpt+150)° C.

After hot forging and hot rolling in the temperature range from (Tpt+20) to (Tpt+150)° C., it is possible to cool the obtained rods to a temperature of 350+500° C. followed by heating them to a temperature in the range from (Tpt−70) to (Tpt−20)° C. and hot deformation.

Forging with a reduction ratio of 1.20-2.50 after heating to a temperature in the range of (Tpt+20)+(Tpt+150)° C. with shear deformations mainly in the longitudinal direction leads to destruction of the cast structure of the material and an increase in the plasticity.

Hot rolling with a change of shear deformation direction to the predominantly transverse one with a reduction ratio up to 7.0 allows additional processing, increases the plasticity of the surface layers of the material, reduces the number and size of surface defects.

Hot rolling directly after the hot forging, without cooling, allows avoiding the formation of a crust on the forged piece surface which, due to cracking at the prolonged cooling and gas saturation, could cause deep pinches during rolling and formation of oxidized areas inside the rod which would lead to the need for mechanical removal of the said crust. Accordingly, the claimed method allows excluding the operation of mechanical removal of the crust.

Thus, the production of rods implementing the claimed operations, with the claimed sequence and at the claimed conditions, reduces the level of defects formation across the section of the rod and on its surface, the metal is processed throughout the whole cross-section, providing a specified structure and a high level of mechanical properties that meet the requirements of customers, Russian and international standards.

Below are the Preferred Embodiments for the proposed method.

DESCRIPTION OF THE PREFERRED EMBODIMENTS

Example 1. An ingot of titanium alloy IIT-7M (Cyrillic) (a alloy, averaged chemical composition 2.2 Al-2.5 Zr, GOST 19807-74 "Wrought titanium and titanium alloys.") was heated to the temperature of Tpt+130° C. and hot forging was carried out on the forging press with a reduction ratio of 1.5. High single deformation due to high plasticity of the metal and deformation heating during forging led to the fact that, by the end of the forging, the forged piece temperature was in the range of (Tpt+20)+(Tpt+150)° C. The forged piece was rolled on the screw rolling mill without heating with the reduction ratio of 3.80. Further, the rod was cut into parts, heated to the temperature of Tpt−40° C. and hot rolled on the screw rolling mill with the reduction ratio of 2.45

We obtained a rod of a given size with the required properties, Table 1, which can be used for the manufacture of pipe workpieces for subsequent hot extrusion, Table 1.

TABLE 1

Physical and mechanical properties of heat-treated rods made from titanium alloy IIT-7M (Cyrillic), the longitudinal direction of samples cutting

| | Test temperature 20° C. | | | | | Test temperature 350° C. | |
|---|---|---|---|---|---|---|---|
| Properties | $\sigma_B$, MPa | $\sigma_{0.2}$, MPa | δ, % | ψ, % | KCU, kJ/m$^2$ | $\sigma_B$, MPa | $\sigma_{0.2}$, MPa |
| Actual | 590-600 | 515-555 | 19-24 | 48-51 | 1280-1501 | 340-345 | 266-278 |
| Requirements | ≥480-650 | ≥380 | ≥18 | ≥36 | ≥1000 | ≥250 | ≥180 |

$\sigma_B$ - ultimate strength;
$\sigma_{0.2}$ - yield strength;
δ - percentage elongation;
ψ - reduction of area;
KCU - impact toughness As follows from Table 1, the rods fully meet the requirements.

A similar result was obtained when manufacturing the rods from other α alloys

Example 2. An ingot of titanium alloy BTEC (Cyrillic) (α+β alloy, averaged chemical composition 5Al-4V, GOST 19807-74 "Wrought titanium and titanium alloys.") was heated to the temperature of Tpt+60° C. and hot forging was carried out on the forging press with the reduction ratio of 2.15. Further, without cooling, the forged piece was heated to the temperature of Tpt+60° C. and rolled on the screw rolling mill with the reduction ratio of 2.78 Then the rod was cooled to an ambient temperature and cut into three equal parts.

The rolled rods were heated in the furnace to the temperature of Tpt−40° C., then the second stage of screw rolling with the reduction ratio of 2.25 was performed.

The deformation of the metal was stable without macro- and microdefects.

After the second stage of rolling, the rods were cooled to ambient temperature and cut into specified lengths.

The rods were divided into two groups. The first group of rods as ready-made large-size rods was sent for the check of compliance with the requirements. At the request of the customer, they were additionally machined.

The second group of rods was heated in the induction furnace to the temperature of Tpt−40° C. and rolled on the screw rolling mill with the reduction ratio of 3.62, then cooled to ambient temperature. The rods were also checked for compliance. At the request of the customer, they were additionally machined.

The obtained rods were characterized by high accuracy of geometrical dimensions and absence of defects. In addition to the basic research (mechanical properties, hardness, macro- and microstructure), the ultrasonic continuity check was carried out on the rods.

The results of properties check are given in Table 2.

TABLE 2

Physical and mechanical properties of the rods made from titanium alloy BT6C (Cyrillic), the direction of samples cutting—longitudinal, test temperature 20° C.

| Diameter/side of the rod, tested samples state | | | $\sigma_B$, MPa | δ, % | ψ, % | KCU, kJ/m$^2$ |
|---|---|---|---|---|---|---|
| Annealed | 10-12 mm | Actual | 951-964 | 14.4-16.8 | 37.8-41.1 | — |
| | (1st group) | Requirements | 835-980 | ≥10 | ≥30 | — |
| | 12-60 mm | Actual | 948-961 | 15.1-16.9 | 37.7-41.2 | 630-890 |
| | (1st group) | Requirements | 835-980 | ≥10 | ≥30 | ≥400 |
| | 60-100 mm | Actual | 946-963 | 15.0-17.0 | 36.2-39.9 | 640-910 |
| | (2nd group) | Requirements | 835-980 | ≥10 | ≥25 | ≥400 |
| | 100-150 mm | Actual | 940-960 | 15.2-16.9 | 37.0-40.5 | 620-870 |
| | (2nd group) | Requirements | 755-980 | ≥7 | ≥22 | ≥400 |

TABLE 2-continued

Physical and mechanical properties of the rods made from titanium alloy BT6C (Cyrillic), the direction of samples cutting—longitudinal, test temperature 20° C.

| Diameter/side of the rod, tested samples state | | | $\sigma_B$, MPa | δ, % | ψ, % | KCU, kJ/m$^2$ |
|---|---|---|---|---|---|---|
| Hardened and aged | 10-12 mm | Actual | 1104-1107 | 8.7-11.9 | 30.2-31.4 | — |
| | (1st group) | Requirements | ≥1030 | ≥6 | ≥20 | — |
| | 12-100 mm | Actual | 1139-1140 | 12.3-12.5 | 43.8-48.2 | 560-600 |
| | (2nd group) | Requirements | ≥1030 | ≥6 | ≥20 | ≥300 |

Note.
Requirements - according to GOST 26492-85 "Titanium and titanium alloys rolled bars" to the high-quality bars.
$\sigma_B$ - ultimate strength;
$\sigma_{0.2}$ - yield strength;
δ - percentage elongation;
ψ - reduction of area;
KCU - impact toughness
The grade of the rod grains - 1 to 3 points, if required - no more than 4 to 8 points (depending on the nomenclature).
Microstructure - of 1 to 5 type, if required of 1 to 7 type.
The side of the rod - for rods of square or rectangular cross-section.

Rods made of alloy BTEC (Cyrillic) of the first group correspond to the requirements to the large-sized rolled rods made from titanium alloys, that of the second group—to the requirements for rolled rods made from titanium alloys.

A similar result was obtained when manufacturing the rods from other α+β alloys.

Example 3 illustrates the manufacture of rods made of pseudo α alloy IIT-3B (Cyrillic) which has a significantly worse plasticity than the alloys in examples 1-2. The ingot of titanium alloy IIT-3B (Cyrillic) (averaged chemical composition 4Al-2V, GOST 19807-74 "Wrought titanium and titanium alloys.") was heated to the temperature of Tpt+125° C. and hot forging was carried out on the forging press with the reduction ratio of 1.25. Further, this forged piece was heated to the temperature of Tpt+125° C. and rolled on the screw rolling mill with the reduction ratio of 2.64 Further, the rod was cut into parts, heated to the temperature of Tpt−25° C. and hot forged on the forging press with the reduction ratio of 4.14 to a rod of circular cross-section of the finished size.

At the customer's request, additional heat or mechanical treatment was performed.

For rods with a rectangular cross-section, the rod after cutting was heated to the temperature of Tpt−25° C. and hot forging was carried out on the forging press with the reduction ratio of 3.16 to a rod of rectangular cross-section of the finished size.

At the customer's request, heat or mechanical treatment was performed.

The properties of the obtained rods of circular and rectangular cross-section of IIT-3B (Cyrillic) alloy are shown in Table 3.

TABLE 3

Physical and mechanical properties of heat-treated rods made from titanium alloy IIT-3B (Cyrillic), the direction of samples cutting - longitudinal

| Diameter/side of rod | | Test temperature 20° C. | | | | | Test temperature 350° C. | | |
|---|---|---|---|---|---|---|---|---|---|
| | | $\sigma_B$, MPa | $\sigma_{0.2}$ MPa | δ, % | ψ, % | KCU, kJ/m$^2$ | $\sigma_B$ MPa | $\sigma_{0.2}$ MPa | H, % of mass |
| ≤100 mm | Actual | 755-805 | 683-734 | 14.8-18.5 | 35.7-50.0. | 1162-1537 | 489-511 | 356-420 | <0.001 |
| | Requirements | ≥638 | ≥589 | ≥10 | ≥25 | ≥687 | ≥343 | ≥294 | ≤0.008 |
| 100-200 mm | Actual | 772-788 | 718-755 | 14.2-17.8 | 31.8-42.3 | 1364-1403 | 445-471 | 392-398 | <0.001 |
| | Requirements | ≥638 | ≥589 | ≥9 | ≥22 | ≥589 | ≥343 | ≥294 | ≤0.008 |
| 200-400 mm | Actual | 764-790 | 712-745 | 13.9-17.1 | 29.2-41.8 | 1420-1501 | 439-465 | 401-412 | <0.001 |
| | Requirements | ≥638 | ≥589 | ≥8 | ≥22 | ≥589 | ≥343 | ≥294 | ≤0.008 |

$\sigma_B$ - ultimate strength;
$\sigma_{0.2}$ - yield strength;
δ - percentage elongation;
ψ - reduction of area;
KCU - impact toughness;
H - hydrogen content.
The side of the rod - for rods of square or rectangular cross-section.

As follows from Table 3, the rods fully meet the presented requirements.

A similar result was obtained when manufacturing the rods from other pseudo α alloys.

The main parameters of the invention Preferred Embodiment within and beyond the claimed limits and the obtained results are shown in Table 4.

TABLE 4

| | Forging | | | Rolling | | Hot deformation | | | |
|---|---|---|---|---|---|---|---|---|---|
| No. | $t_1$, ° C. | $\mu_1$ | Heating | $t_2$, ° C. | $\mu_2$ | type | $t_3$, ° C. | $\mu_3$ | Obtained result |
| 1 | Tpt + 60 | 2.15 | Yes | Tpt + 60 | 2.78 | R | Tpt − 40 | 3.63 | Meets the requirements, high |
| 2 | Tpt + 125 | 1.27 | Yes | Tpt + 125 | 2.64 | F | Tpt − 25 | 4.14 | performance |
| | | | Yes | | | F | Tpt − 25 | 3.16 | |
| 3 | Tpt + 130 | 1.50 | No | Tpt + 130 | 3.80 | R | Tpt − 30 | 2.46 | |
| 4 | Tpt + 130 | 1.10 | No | Tpt + 70 | 4.20 | R | Tpt − 40 | 4.18 | Small deformation on the forging has led to a shrinkage depression on the rolling - low yield ratio and low productivity |
| 5 | Tpt + 10 | 1.31 | Yes | Tpt + 60 | 3.10 | F | Tpt − 40 | 2.91 | Cracking at the forging stage, high |
| 6 | Tpt + 100 | 2.85 | Yes | Tpt + 60 | 3.10 | F | Tpt − 40 | 2.91 | metal losses at the intermediate turning - low yield ratio and low productivity |
| 7 | Tpt + 80 | 2.31 | Yes | Tpt + 10 | 2.78 | F | Tpt − 40 | 3.63 | Defects of continuity in the axial |
| 8 | Tpt + 80 | 2.31 | Yes | Tpt + 80 | 8.00 | F | Tpt − 40 | 3.63 | zone occurred during rolling - low yield ratio and low productivity |
| 9 | Tpt + 90 | 2.30 | Yes | Tpt + 90 | 4.68 | R | Tpt − 10 | 2.41 | Non-compliance by the structural condition, overheating during hot deformation (R) - defective products |
| 10 | Tpt + 90 | 2.30 | Yes | Tpt + 90 | 4.68 | R | Tpt − 80 | 2.08 | Defects of continuity in the axial zone occurred during hot deformation (R) - non-compliance with the requirements |
| 11 | Tpt + 90 | 2.30 | Yes | Tpt + 90 | 4.68 | F | Tpt − 80 | 2.08 | Low plasticity of the metal at the stage of hot deformation (F) requires additional heating - increased production cycle, low productivity |

Note:
R—rolling;
F—forging.

INDUSTRIAL APPLICABILITY

The proposed invention was tested in the production of JSC CHMZ when manufacturing the rods from alloys IIT-7M, IIT-1M (Cyrillic) (α-alloys), BTEC, IIT-3B, 2B (Cyrillic) (pseudo α alloys), BT6, BT3-1, BT9 (Cyrillic) (α+β alloys) and other titanium alloys.

The results of the invention embodiment showed that the rods with a cross section size from 10 to 180 mm with specified macro- and microstructures and mechanical properties were obtained.

Rods made by the method according to the invention meet the requirements to workpieces or products made from titanium alloys in the form of rods used for the nuclear reactor cores, as well as in the chemical, oil and gas industry, and medicine.

At the same time, the method provides a lower cost by reducing the manufacturing cycle, increasing the yield ratio, significant reduction in the number of defective products.

The invention claimed is:

1. A method of manufacturing a rod from a titanium alloy, the method including hot forging of a workpiece and the subsequent hot deformation, characterized in that:

a) hot forging of an ingot is performed after heating the ingot to a temperature in the interval from (Tpt+20) to (Tpt+150)° C. with shear deformations mainly in a longitudinal direction and a reduction ratio k=(1.2–2.5), thereby providing a forged piece;

b) after step a), without cooling, hot rolling of the forged piece is performed in the temperature range of (Tpt+20)+(Tpt+150)° C. with a change of shear deformations into a predominantly transverse direction and a reduction ratio of up to 7.0, the transverse direction being transverse relative to the longitudinal direction, and the hot rolling step providing a deformed workpiece; and c) the subsequent hot deformation is carried out by heating the deformed workpiece in the temperature range from (Tpt−70) to (Tpt−20)° C., where Tpt is the temperature of polymorphic transformation of the ingot.

2. The method according to claim 1, wherein before hot rolling, the forged piece is heated to a temperature range from (Tpt+20) to (Tpt+150)° C.

3. The method according to claim 1, wherein after hot forging and hot rolling, the deformed workpiece is cooled to the temperature of 350+500° C. followed by heating the deformed workpiece to a temperature in the range from (Tpt−70) to (Tpt−20)° C. and the subsequent hot deformation of the deformed workpiece.

* * * * *